US009403266B2

(12) United States Patent
Zhang et al.

(10) Patent No.: US 9,403,266 B2
(45) Date of Patent: Aug. 2, 2016

(54) POWER TOOL

(71) Applicant: Black & Decker Inc., Newark (DE)

(72) Inventors: Bob Zhang, Xuzhou (CN); Paik Gu, Suzhou (CN)

(73) Assignee: Black & Decker Inc., New Britain, CT (US)

( * ) Notice: Subject to any disclaimer, the term of this patent is extended or adjusted under 35 U.S.C. 154(b) by 0 days.

(21) Appl. No.: 14/613,021

(22) Filed: Feb. 3, 2015

(65) Prior Publication Data

US 2015/0151420 A1 Jun. 4, 2015

Related U.S. Application Data

(63) Continuation of application No. PCT/CN2012/078178, filed on Jul. 4, 2012.

(51) Int. Cl.

| | |
|---|---|
| ***B25F 5/00*** | (2006.01) |
| ***B24B 23/02*** | (2006.01) |
| ***H01H 9/06*** | (2006.01) |

(52) U.S. Cl.

CPC ..... *B25F 5/00* (2013.01); *B24B 23/028* (2013.01); *B25F 5/008* (2013.01); *H01H 9/06* (2013.01)

(58) Field of Classification Search

USPC ..... 310/50, 71

See application file for complete search history.

(56) References Cited

U.S. PATENT DOCUMENTS

| | | | | |
|---|---|---|---|---|
| 8,752,646 | B2 * | 6/2014 | Fujiwara | B25F 5/008 173/217 |
| 8,816,544 | B2 * | 8/2014 | Tanimoto | B24B 23/028 310/50 |
| 2003/0190877 | A1 * | 10/2003 | Gallagher | B24B 23/02 451/344 |
| 2005/0153636 | A1 * | 7/2005 | Numata | B24B 23/028 451/358 |
| 2008/0014844 | A1 * | 1/2008 | Pontieri | B24B 23/022 451/359 |
| 2009/0145621 | A1 * | 6/2009 | Lau | B25F 5/008 173/217 |
| 2010/0117580 | A1 * | 5/2010 | Miwa | B25F 5/00 318/472 |
| 2010/0117581 | A1 * | 5/2010 | Miwa | H02P 29/0061 318/472 |

FOREIGN PATENT DOCUMENTS

| | | | |
|---|---|---|---|
| CN | 101379578 | A | 3/2009 |
| CN | 102076467 | A | 5/2011 |
| CN | 202006412 | U | 10/2011 |
| CN | 202045549 | U | 11/2011 |

OTHER PUBLICATIONS

International Search Report Apr. 11, 2013.

* cited by examiner

*Primary Examiner* — Naishadh Desai
(74) *Attorney, Agent, or Firm* — Amir Rohani

(57) ABSTRACT

A power tool comprising a housing; an electric motor mounted within the housing; an insulated electric wire electrically connected to the motor and which is capable of providing an electric current to the motor; an electric switch connected in series with the wire, the electrical switch comprising a body and at least one electrical terminal plate extending from the body, wherein an exposed end of the insulated electric wire is electrically connected to the end of the terminal plate, and the exposed end of the wire and the end of the terminal plate are enclosed within an insulating sleeve; and a resilient insulating tube mounted on and surrounding the terminal plate, the resilient insulating tube being positioned on the terminal plate between the insulating sleeve and the body of the switch to enclose the part of the terminal plate located between the body and the insulating sleeve.

8 Claims, 6 Drawing Sheets

POWER TOOL

CROSS-REFERENCE TO RELATED APPLICATIONS

This application is a continuation of co-pending International Application No. PCT/CN2012/078178 filed Jul. 4, 2012.

FIELD OF THE DISCLOSURE

The present invention relates to a power tool, in particular to an angle grinder, and more in particular, to a toggle switch for an angle grinder.

SUMMARY

FIGS. 1 to 3 which discloses a prior art design of angle grinder, the angle grinder comprises a plastic rear motor housing 2 which is connected to a metal gear housing 4 via bolts (not shown) located within threaded passageways 6 formed in the two housings. The rear motor housing comprises two clam shells 8, 10 which are attached to each other with bolts (not shown) along a vertical plane 12 as best seen in FIG. 3.

An electric motor (generally indicated by the dashed lines 14 in FIG. 2) is mounted within the motor housing 2. A motor spindle (generally indicated by the dashed lines 16 in FIG. 2) of the motor 14 rotationally drives an output spindle 18 of the grinder via a gear box (generally indicated by the dashed lines 20 in FIG. 2). The gear box 20 is mounted within the gear housing 4 and typically comprises a bevel gear. The gear box 20 alters the rotational speed of the output spindle 18 versus the motor spindle 16, as well as allowing the axis of rotation of the output spindle 18 to be located perpendicularly relative to the axis of rotation of the motor spindle 16.

Forward vents 22 are formed in the side of the motor housing 2 adjacent the front end of the motor 14 to allow a fan (generally indicated by the dashed lines 60 in FIG. 2), mounted on the motor spindle 16, to draw air into the motor housing and then force it to flow over the motor 14 to cool it. Rear vents 24 are formed in the motor housing 2 to allow the warm air to be expelled from the motor housing after it has passed over the motor 14.

Removable access caps 26 are formed the side of the motor housing adjacent each of the brushes (not shown) of the motor 14 to enable the brushes to be replaced without dismantling the angle grinder.

The electric motor 14 is powered by a mains electricity supply which is provided to the grinder via an electric cable 28 which enter the motor housing 2 of the grinder at the rear. The electric cable comprises electrically insulted wires, 46, 47, 48 which form a circuit. The electric cable 28 connects to the motor 14 via a toggle switch 30 which enables the operator to switch the motor 14 on and off.

An example of such a toggle switch is 30 shown at FIG. 4.

The toggle switch 30 comprises body 32, extending from which are two metal plates 34 which act as electric terminals for the switch 30. The toggle switch 30 is connected in series with the wires 46, 47 of the electric circuit 36 of the motor 14 as shown in FIG. 5. The plates 34 are connected by being soldered to exposed ends of the wires 46, 47. Alternatively, the ends of the wires may comprise female connectors which receive the plates 34 within them in an electrically conductive manner, and which may then be crimped. A pivotal toggle 38 extends from the body 32 which can be pivoted between two positions, a first position 40 shown in FIGS. 4 and 5 by solid lines and a second position 40' shown in FIGS. 4 and 5 by the dashed lines. When the toggle is in its first position, an electrical connection is made between the two plates 34 allowing the motor 14 to run. When the toggle 38 is in its second position, the electrical connection between the plates 34 is broken and the flow of electrical current through the switch is prevented. As such, the motor 14 is switched off. A rubber boot 42 connects between the toggle 38 and the body 32 to prevent the ingress of dirt into the body of the switch via the opening in the body 32 through which the toggle 38 projects.

During use, a grinding or cutting disks is rigidly attached to the output spindle 18. The motor is then activated using the toggle switch 30 and the operator manually manipulates angle grinder to use the grinding or cutting disk to grind or cut a work piece. Often the work piece is made from metal such as a metal girder.

However, a problem has been found with the operation of existing designs grinder. During use, metal filings generated by the cutting action of the grinder are drawn inside of the housing 2 via the vent 22 of the grinder due to the air flow generated by the fan 60. Whilst a proportion of these will be subsequently expelled from the housing, a residual amount will collect on internal components located inside of the motor housing 2. This includes the body 32 and metal plates 34 of the toggle switch 30. In existing designs of grinder, parts or all of the plates 34 remain exposed. As such, when a sufficient amount of metal filings has congregated on the body 32 and plates 34 of the toggle switch, a short circuit is formed directly between the plates 34. When electric power is provided to the grinder, the electrical power short circuits the toggle switch by being able to conduct between the plates 34 via the metal filings. This is dangerous for two reasons. Firstly, as soon as electrical power is connected to angle grinder, it will immediately commence to operate with the operator unable to stop its operation without removing the power supply. Secondly, the short circuit can lead to the switch setting fire which, as the motor housing is made of plastic, results in the housing setting on fire.

The object of the present invention is to provide an improved design which overcomes or at least reduces the problems associated with existing designs. FIGS. 1 to 3 which discloses a prior art design of angle grinder, the angle grinder comprises a plastic rear motor housing 2 which is connected to a metal gear housing 4 via bolts (not shown) located within threaded passageways 6 formed in the two housings. The rear motor housing comprises two clam shells 8, 10 which are attached to each other with bolts (not shown) along a vertical plane 12 as best seen in FIG. 3.

An electric motor (generally indicated by the dashed lines 14 in FIG. 2) is mounted within the motor housing 2. A motor spindle (generally indicated by the dashed lines 16 in FIG. 2) of the motor 14 rotationally drives an output spindle 18 of the grinder via a gear box (generally indicated by the dashed lines 20 in FIG. 2). The gear box 20 is mounted within the gear housing 4 and typically comprises a bevel gear. The gear box 20 alters the rotational speed of the output spindle 18 versus the motor spindle 16, as well as allowing the axis of rotation of the output spindle 18 to be located perpendicularly relative to the axis of rotation of the motor spindle 16.

Forward vents 22 are formed in the side of the motor housing 2 adjacent the front end of the motor 14 to allow a fan (generally indicated by the dashed lines 60 in FIG. 2), mounted on the motor spindle 16, to draw air into the motor housing and then force it to flow over the motor 14 to cool it. Rear vents 24 are formed in the motor housing 2 to allow the warm air to be expelled from the motor housing after it has passed over the motor 14.

Removable access caps 26 are formed the side of the motor housing adjacent each of the brushes (not shown) of the motor 14 to enable the brushes to be replaced without dismantling the angle grinder.

The electric motor 14 is powered by a mains electricity supply which is provided to the grinder via an electric cable 28 which enter the motor housing 2 of the grinder at the rear. The electric cable comprises electrically insulted wires, 46, 47, 48 which form a circuit. The electric cable 28 connects to the motor 14 via a toggle switch 30 which enables the operator to switch the motor 14 on and off.

An example of such a toggle switch is 30 shown at FIG. 4.

The toggle switch 30 comprises body 32, extending from which are two metal plates 34 which act as electric terminals for the switch 30. The toggle switch 30 is connected in series with the wires 46, 47 of the electric circuit 36 of the motor 14 as shown in FIG. 5. The plates 34 are connected by being soldered to exposed ends of the wires 46, 47. Alternatively, the ends of the wires may comprise female connectors which receive the plates 34 within them in an electrically conductive manner, and which may then be crimped. A pivotal toggle 38 extends from the body 32 which can be pivoted between two positions, a first position 40 shown in FIGS. 4 and 5 by solid lines and a second position 40' shown in FIGS. 4 and 5 by the dashed lines. When the toggle is in its first position, an electrical connection is made between the two plates 34 allowing the motor 14 to run. When the toggle 38 is in its second position, the electrical connection between the plates 34 is broken and the flow of electrical current through the switch is prevented. As such, the motor 14 is switched off. A rubber boot 42 connects between the toggle 38 and the body 32 to prevent the ingress of dirt into the body of the switch via the opening in the body 32 through which the toggle 38 projects.

During use, a grinding or cutting disks is rigidly attached to the output spindle 18. The motor is then activated using the toggle switch 30 and the operator manually manipulates angle grinder to use the grinding or cutting disk to grind or cut a work piece. Often the work piece is made from metal such as a metal girder.

However, a problem has been found with the operation of existing designs grinder. During use, metal filings generated by the cutting action of the grinder are drawn inside of the housing 2 via the vent 22 of the grinder due to the air flow generated by the fan 60. Whilst a proportion of these will be subsequently expelled from the housing, a residual amount will collect on internal components located inside of the motor housing 2. This includes the body 32 and metal plates 34 of the toggle switch 30. In existing designs of grinder, parts or all of the plates 34 remain exposed. As such, when a sufficient amount of metal filings has congregated on the body 32 and plates 34 of the toggle switch, a short circuit is formed directly between the plates 34. When electric power is provided to the grinder, the electrical power short circuits the toggle switch by being able to conduct between the plates 34 via the metal filings. This is dangerous for two reasons. Firstly, as soon as electrical power is connected to angle grinder, it will immediately commence to operate with the operator unable to stop its operation without removing the power supply. Secondly, the short circuit can lead to the switch setting fire which, as the motor housing is made of plastic, results in the housing setting on fire.

The object of the present invention is to provide an improved design which overcomes or at least reduces the problems associated with existing designs.

Accordingly there is provided a power tool comprising: a housing; an electric motor mounted within the housing; an insulated electric wire electrically connected to the motor and which is capable of providing an electric current to the motor; an electric switch connected in series with the wire, the electrical switch comprising a body and at least one electrical terminal plate extending from the body wherein an exposed end of the insulated electric wire is electrically connected to the end of the terminal plate, the exposed end of the wire and the end of the terminal plate being enclosed within an insulating sleeve characterized in that a resilient insulating tube is mounted on and surrounds the terminal plate, the resilient insulating tube being positioned on the terminal plate between the insulating sleeve and the body of the switch to enclose the part of the terminal plate located between the body and the insulating sleeve.

Use of an insulating sleeve in isolation has resulted in small parts of the plate between the insulating sleeve and body of the switch remaining exposed due to manufacturing processes and tolerances in component parts. Therefore, the use of an insulating resilient tube in addition to an insulating sleeve ensures that whole of the plate is enclosed. The resilient nature of the tube ensures that any exposed part is enclosed as it expands to fill the gaps.

DETAILED DESCRIPTION

Figure 1:
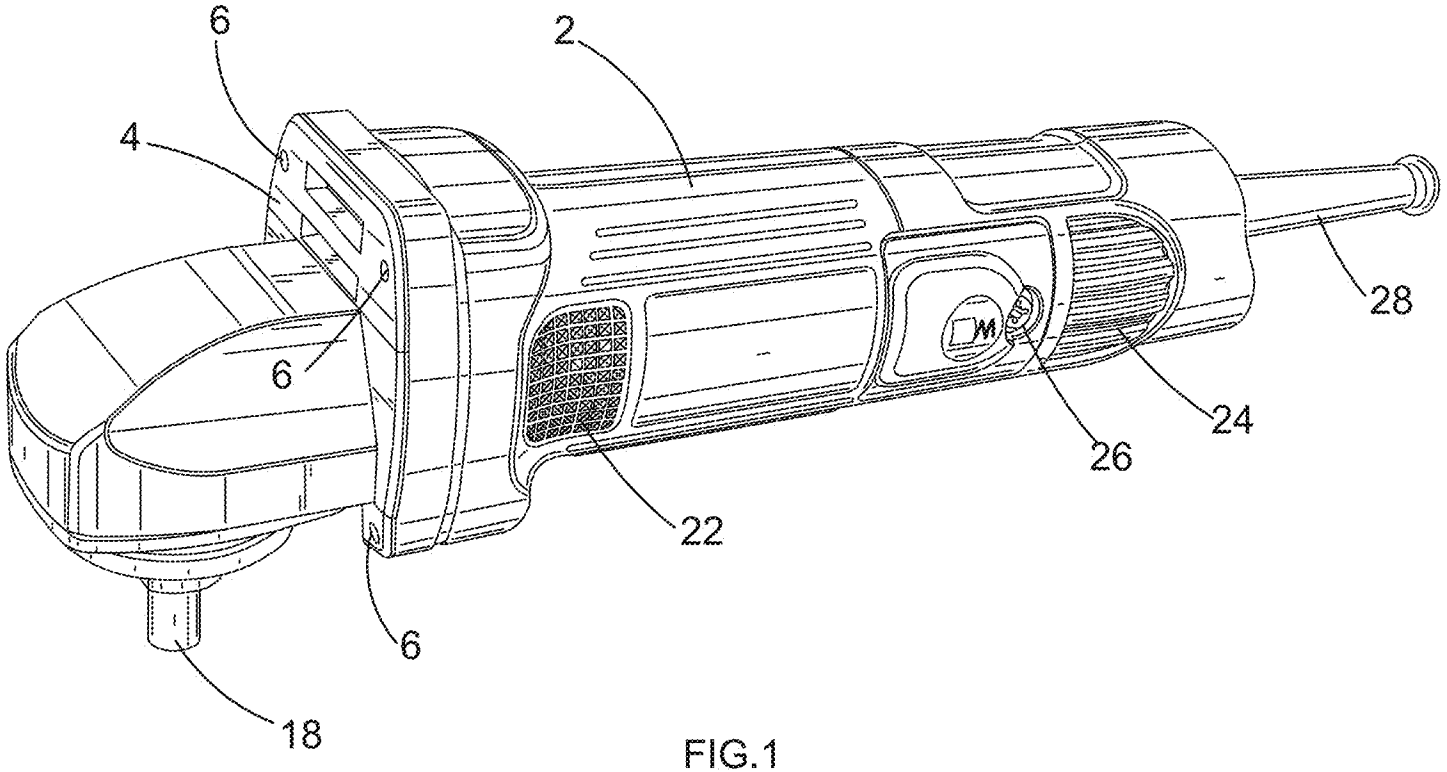
FIG. 1 shows a perspective view of an existing design of angle grinder.
Figure 2:
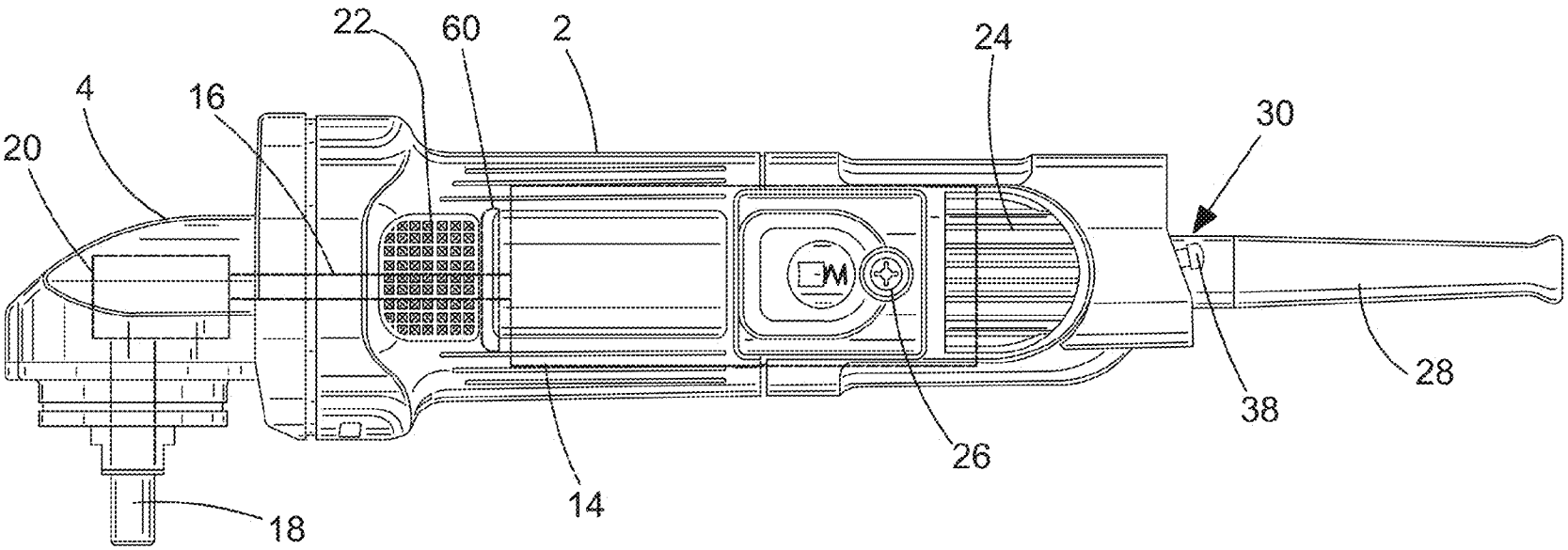
FIG. 2 shows a side view of the angle grinder of FIG. 1.
Figure 3:
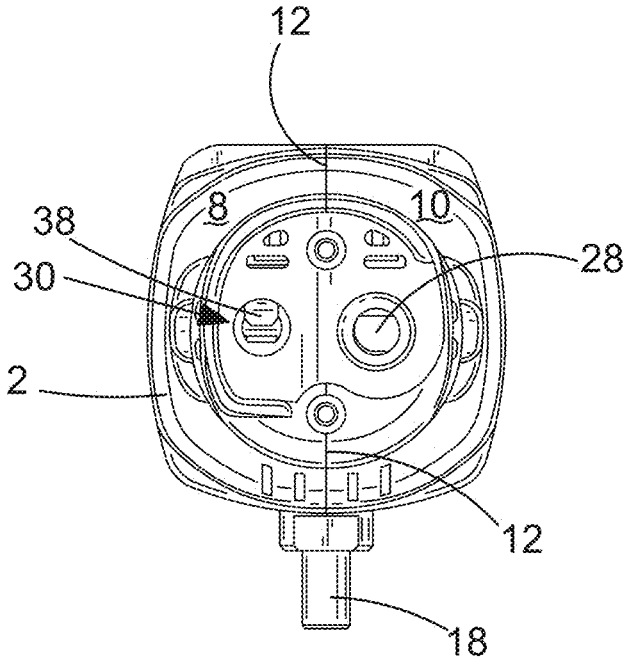
FIG. 3 shows a rear view of the angle grinder of FIG. 1.
Figure 4:
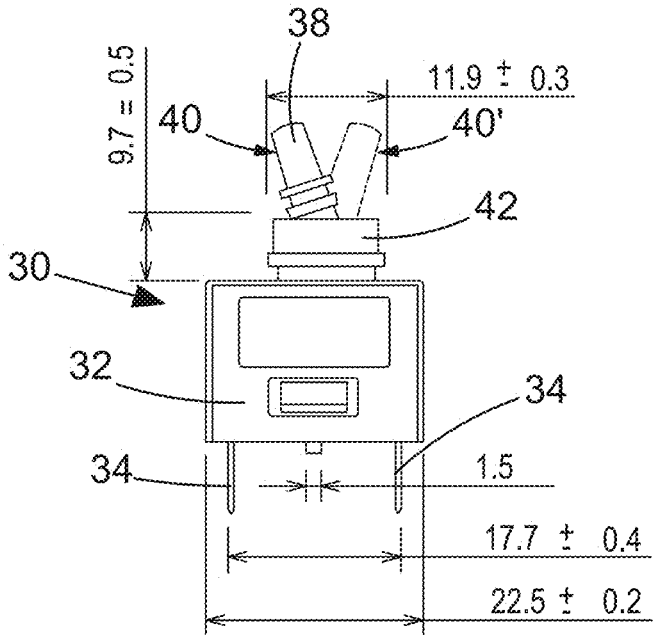
FIG. 4 shows a side view of a toggle switch.
Figure 5:
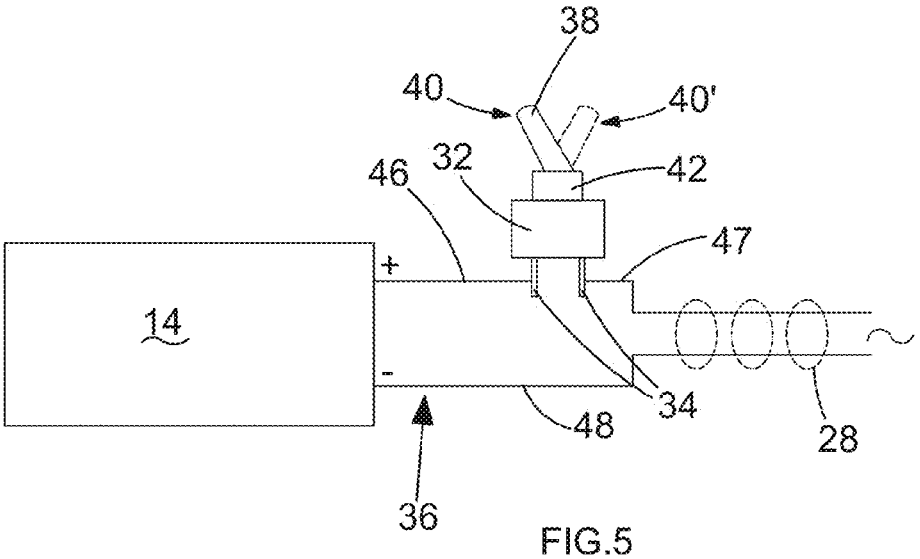
FIG. 5 show the electric circuit of the motor.
Figure 6:
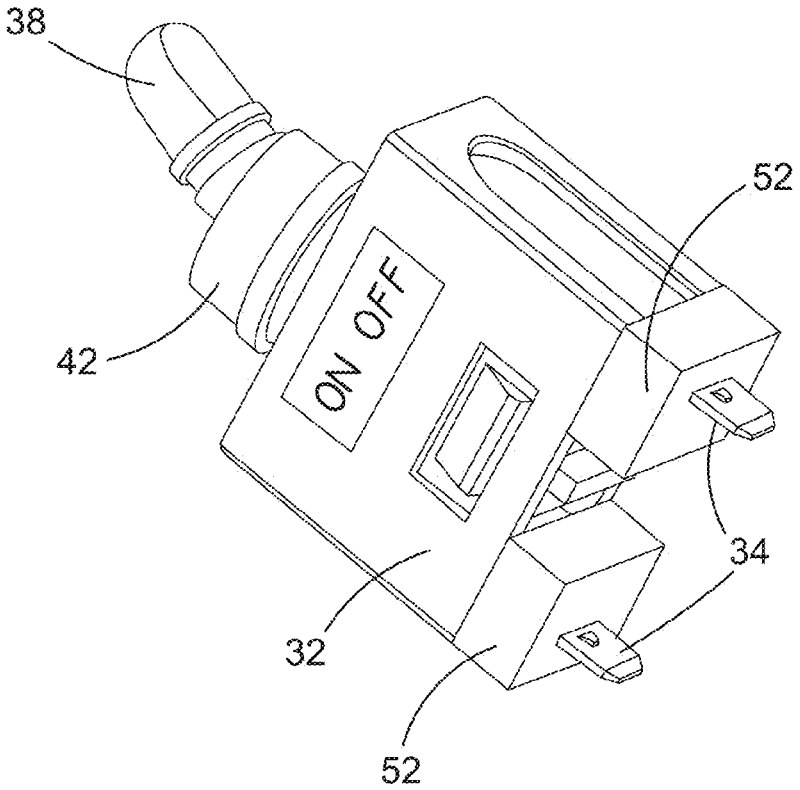
FIG. 6 shows a side view of a toggle switch in accordance with an embodiment of the present invention.

An embodiment of the invention will now be described with reference to FIGS. 6 to 9.

The toggle switch 30 of the embodiment is mounted within the housing 2 and located within the circuit 36 in the same manner as that described previously. However, the electrical connection between each of the plates 34 of the toggle switch and the exposed ends of the electrical wires 46, 47 are encapsulated within an insulating sleeve 50 and an insulating resilient tube 52.

The insulating sleeve 50 is a commercially available sleeve which is used to enclosed exposed parts of electric wires and the ends of the plates 34 to which they are connected. The sheaf can be made of plastic material. Such sheaths may be capable of being shrink fitted by being heated, causing the diameter of the sleeve to reduce thereby causing it to encapsulate the exposed part of the electric wire and sleeve. Alternatively, the sleeve may be a rubber sleeve which may be held in place by being tight fitted over the exposed part of the electric wire.

Figure 7:
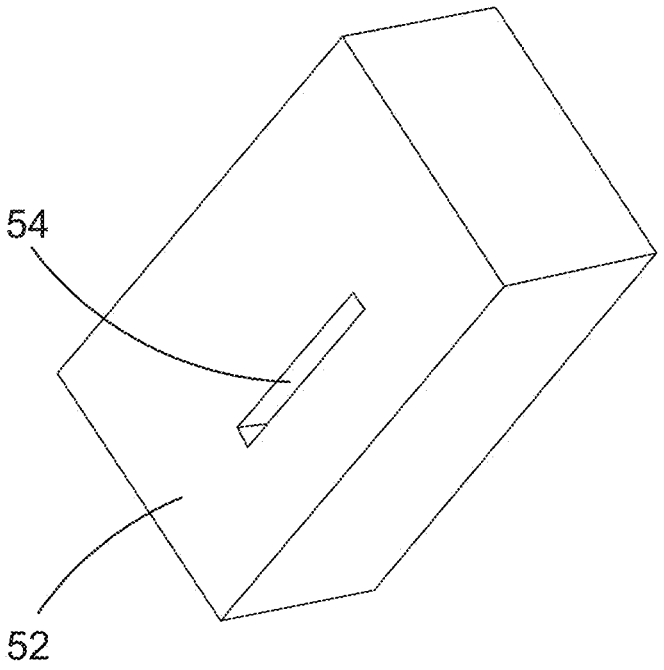
FIG. 7 shows a block of the resilient polyurethane flame retardant sponge material with aperture for a plate.

The resilient insulating tube 52 is shown in FIG. 7 and comprises a block of polyurethane flame retardant sponge material. An aperture 54 is formed through the length of the block to enable the plate 34 of the switch to pass through it.

Figure 8:
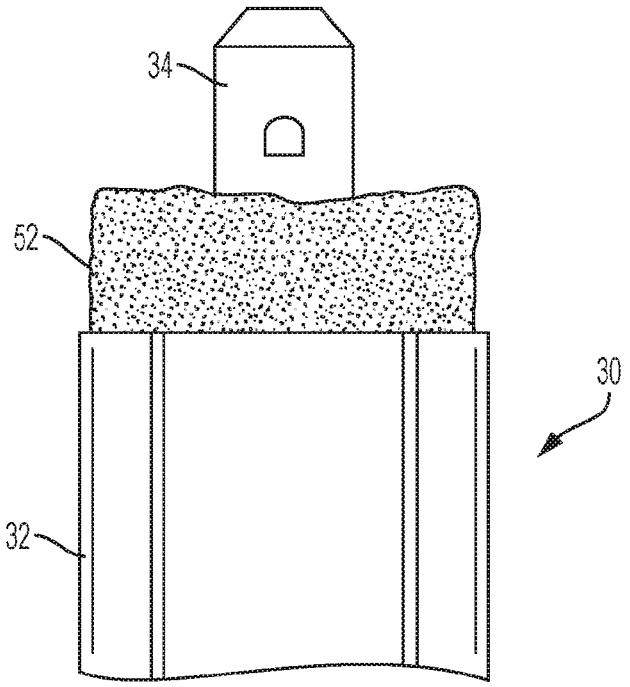
FIG. 8 shows a block of the resilient polyurethane flame retardant sponge material mounted on a plate of the toggle switch.
Figure 9:
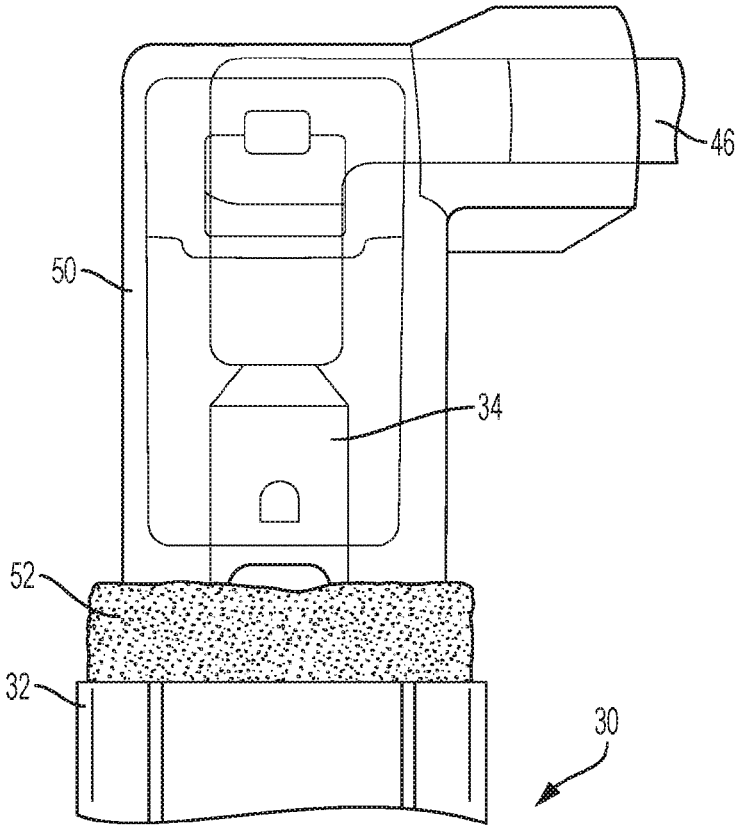
FIG. 9 shows the plate with the block of the resilient polyurethane flame retardant sponge material attached to an electric wire.

When the toggle switch is being assembled inside the motor housing 2, each of the plates 34 is inserted into a resilient insulating tube 54 which is slid up against the body 32 of the switch, exposing the end of the plate 34 as shown in FIG. 8. The exposed end of the corresponding electric wire 46, 47 (and female connector if such a type connection is being used) is passed through an insulating sleeve 50 and then electrically and mechanically connected to the exposed end the plate 34. The insulating sleeve 50 is then located to enclose the end of the plate 34 and the exposed end of the wire 46, 47 and then fixed in place (for example by being shrink wrapped). Due to the resilient nature of the resilient insulating tubes 52, the resilient insulating tubes 52 enclose the each of the plates 34 between the body 32 of the switch and the insulating sleeve 50 as shown in FIG. 9. As such, the whole of the plates are enclosed. Therefore, any metal filings cannot provide a short circuit between the plates 34.

Whilst the present embodiment has been described in relation to an angle grinder, it will be appreciated that the invention could be utilized on any type of power tool.

The invention claimed is:

1. A power tool comprising:

a housing;

an electric motor mounted within the housing;

an insulated electric wire electrically connected to the motor and which is capable of providing an electric current to the motor;

an electric switch connected in series with the wire, the electrical switch comprising a body and at least one electrical terminal plate extending from the body, wherein an exposed end of the insulated electric wire is electrically connected to the end of the terminal plate, and the exposed end of the wire and the end of the terminal plate are enclosed within an insulating sleeve; and a resilient insulating tube mounted on and surrounding the terminal plate, the resilient insulating tube being positioned on the terminal plate between the insulating sleeve and the body of the switch to enclose the part of the terminal plate located between the body and the insulating sleeve.

2. A power tool of claim 1, wherein the resilient insulating tube is made from polyurethane.

3. A power tool of claim 1, wherein the resilient insulating tube is made from a flame retardant material.

4. A power tool of claim 1, wherein the resilient insulating tube is made from a sponge material.

5. A power tool of claim 1, wherein the electrical switch is a toggle switch.

6. A power tool of claim 1, wherein the electrical switch is an ON/OFF switch for activating and deactivating the motor.

7. A power tool of claim 1, wherein there is further provide a fan rotatably mounted within the housing, for drawing air through the housing, wherein the body of the electric switch and the at least one electrical terminal plate of the switch are both positioned within the housing.

8. A power tool of claim 7, wherein the fan is rotatably driven by the motor.

* * * * *